United States Patent [19]

Ono et al.

[11] Patent Number: 4,811,705

[45] Date of Patent: Mar. 14, 1989

[54] HORIZONTAL-SHAFT OHV ENGINE

[75] Inventors: Hiromi Ono, Akashi; Tetsuaki Shirai, Kobe, both of Japan

[73] Assignee: Kawasaki Jukogyo Kabushiki Kaisha, Kobe, Japan

[21] Appl. No.: 145,558

[22] Filed: Jan. 19, 1988

[30] Foreign Application Priority Data

Jan. 22, 1987 [JP] Japan ..... 62-7777[U]

[51] Int. Cl.[4] ..... F02F 7/00

[52] U.S. Cl. ..... 123/195 AC

[58] Field of Search ..... 123/195 AC, 195 HC, 123/196 W

[56] References Cited

U.S. PATENT DOCUMENTS

| | | | |
|---|---|---|---|
| 2,493,974 | 1/1950 | Jozif | 123/195 AC |
| 2,714,376 | 8/1955 | Bakke et al. | 123/195 AC |
| 3,109,416 | 11/1963 | Rose et al. | 123/195 AC |
| 4,570,584 | 2/1986 | Uetsuji et al. | 123/196 W |
| 4,671,216 | 6/1987 | Itoh | 123/195 AC |

FOREIGN PATENT DOCUMENTS

| | | | |
|---|---|---|---|
| 0289694 | 8/1973 | U.S.S.R. | 123/195 AC |

*Primary Examiner*—Willis R. Wolfe

*Attorney, Agent, or Firm*—Mashall, O'Toole, Gerstein, Murray & Bicknell

[57] ABSTRACT

An overhead valve engine including a bottom mounting part and a crankcase mounted on and extending upwardly from the mounting part. A crankshaft and a camshaft are rotatably mounted on the crankcase, the shafts being at substantially the same vertical height above the mounting part. A cylinder is formed in the crankcase and has a cylinder axis which slants at an angle of substantially 45° upwardly and over said cam shaft. Air intake and exhaust valves are provided at the upper end of the cylinder, a curburetor is mounted on a side of the crankcase at a level which is below the valves, and an air inlet manifold extends from the air intake valve downwardly to the carburetor. Two push rods extend between the camshaft and the valves, and the air inlet manifold extends between the two push rods.

7 Claims, 2 Drawing Sheets

HORIZONTAL-SHAFT OHV ENGINE

FIELD AND BACKGROUND OF THE INVENTION

This invention relates to an overhead-valve, horizontal-shaft, general-purpose internal combustion engine, and more particularly to the arrangement and construction of a compact engine of this type which is particularly useful for mounting on a cultivator or a portable electric generator.

Conventionally, a side valve (SV) engine has been exclusively used where a compact, horizontal-shaft, general-purpose engine is required for a cultivator or a generator, for example. This engine design is used because the overall contour of the engine is compact and generally cubic so that it is suitable for mounting on cultivators or other various types of work equipment, because the construction of the engine itself is not complicated, and also because the cost of production is low.

Such a horizontal-shaft general-purpose SV engine is generally constructed to adapt to one of two types of systems. In one of the two systems, a power output shaft extends directly from the crankshaft. In the other system, a power output shaft extends from the camshaft and has a rotational speed about one-half that of the crankshaft, and this engine is used in applications where relatively low speeds are needed.

In recent years, in lieu of side valve engines as described above, overhead valve (OHV) engines have gained popularity due to their higher burning efficiency, larger horsepower per unit displacement, lower vibration levels, and other advantages.

In the OHV engine, however, because the valves are located in the upper portion of the engine cylinder, the conventional engine has a higher vertical dimension than an SV engine. The conventional way to mount a general-purpose OHV engine in a specified height has been, as shown in FIG. 3, to incline the axis of the cylinder 1 at about 55–65 degrees. As shown in FIG. 4, the conventional OHV engine has a carburetor 9 located on the side of the upper portion of the inclined cylinder, which is on the side opposite the output shaft 2, and has an air cleaner 10 provided through and above an L-shape air-inlet pipe 13. A fuel tank 11 is mounted above the crankcase 4 (see FIG. 3), and the fuel is fed by gravity flow through a fuel pipe (not shown) to the carburetor 9.

In the arrangement and construction of the above-mentioned horizontal-shaft, compact general-purpose OHV engine, it is impossible to establish a large engine head between the fuel tank and the carburetor. For this reason, this gravity type fuel feed, compact, general-purpose engine suffers from its inability to be used when the entire engine is in an inclined position during operation. The power output shaft extending from the camshaft 3 (FIG. 3) is so close to the engine mount base, that a large-diameter pulley cannot be mounted on the output shaft side in a camshaft speed-reducing engine. If the camshaft driving gear 3' is immersed in the engine oil in the crankcase, the oil agitation causes oil temperature buildup. Thus, the oil level must be lowered according to the position of the camshaft 3, making it difficult to reserve a sufficient amount of oil. As described hereinabove, in such a construction where the carburetor 9 is located on a side of the upper portion of the cylinder 1, the end face of the carburetor 9 which connects with the air cleaner 10 projects almost up to the end face of the fan cover 16. Accordingly, it is necessary to connect the carburetor 9 with the air cleaner 10, which is located above the carburetor 9, indirectly through the L-shaped inlet pipe 13 or the like, resulting in a more complicated construction and a lower breathing efficiency. Furthermore, unused or dead space D is created below the cylinder 1, which makes the external dimensions of the entire engine larger.

It is a general object of this invention to provide a horizontal-shaft, compact, general-purpose OHV engine which overcomes the foregoing problems and has compact external dimensions per engine displacement.

SUMMARY OF THE INVENTION

An overhead valve engine according to this invention comprises a horizontal crankshaft, and a camshaft in driving engagement with the crankshaft and having a pair of cams thereon. The camshaft extends in parallel with and at substantially the same height or vertical level as the crankshaft. The engine further comprises a cylinder having an axis inclined at approximately 45 degrees toward the side which includes the camshaft. A pair of push rods extend through the cylinder head and substantially in parallel with the cylinder axis , and are reciprocated by the cams to operate intake and exhaust valves on the cylinder head. An intake port is formed in the cylinder head and connected to the intake valve. The intake port extends between the push rods substantially perpendicularly to the crankshaft. The intake port is connected with a carburetor through a curved intake manifold so that the carburetor is positioned substantially in parallel with the crankshaft. An air cleaner is connected with and mounted adjacent the carburetor on the side opposite a power output shaft, which shaft extends from either the crankshaft or the camshaft. An exhaust port is also formed in the cylinder block and is connected to an exhaust manifold.

This engine enables a large-diameter pulley to be mounted on the power output shaft and a sufficient amount of engine oil to be reserved, due to the camshaft being located at approximately the same height as the crankshaft. The cylinder is inclined approximately at 45 degrees toward the camshaft, and the intake port opens in the cylinder head between the push rods substantially perpendicularly to the crankshaft. The carburetor is connected with the intake port through the intake manifold substantially in parallel with the crankshaft, thereby enabling the carburetor to be positioned below the cylinder, eliminating all unnecessary space. This arrangement also allows the air cleaner to be located adjacent the carburetor on the side of the engine which is opposite the power output shaft. This leads to a simplified construction and improved breathing efficiency.

Since the cylinder is tilted at about 45 degrees, the engine has a compact and cubic appearance.

A sufficient vertical distance between the fuel tank and the carburetor permits gravity fuel feed even when the engine is inclined considerably during use.

BRIEF DESCRIPTION OF THE DRAWINGS

The invention will be better understood from the following detailed description taken in conjunction with the accompanying figures of the drawings, wherein.

DETAILED DESCRIPTION OF THE PREFERRED EMBODIMENT

Figure 1:
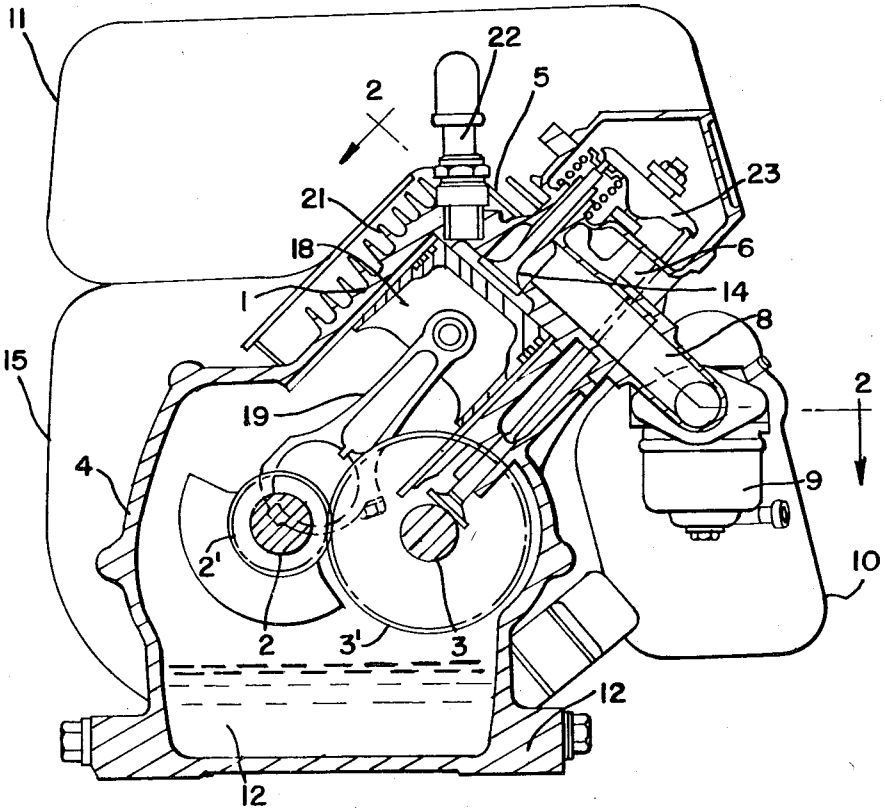
FIG. 1 is a vertical cross sectional view of a horizontal-shaft, compact, general-purpose OHV engine, constructed in accordance with this invention.

With reference to FIG. 1, which illustrates a single-cylinder engine, the engine includes a cylinder 1 formed on the upper side of a crankcase 4. The crankcase journals a crankshaft 2 and a camshaft 3 which are substantially horizontal and are parallel to each other and are at substantially the same level or vertical height above an engine base mount 12. The camshaft 3 is driven by the crankshaft 2 through a stepdown gear mechanism which includes a crankgear 2' and a cam gear 3'. An end of the camshaft 3 extends out of the crankcase 4 toward the viewer of FIG. 1, and forms a power output shaft.

The cylinder 1 has a cylinder bore formed in it, and a piston 18 reciprocates in the bore. A crank arm 19 connects the piston 18 with the crankshaft 2 in order to rotate the shaft 2, in the conventional manner. The engine is an air-cooled type and has cooling fins 21 on the outside of the cylinder 1. A spark plug 22 is mounted on a cylinder head 5 and, of course, projects into the upper end of the cylinder bore.

The axis of the bore of the cylinder 1 is inclined at about 45 degrees toward the side that includes the camshaft 3, so that the upper end of the cylinder bore is above the camshaft 3. Cams (not shown) are formed on the cam shaft 3 and rocker arms 23 are mounted on the head 5. A pair of push rods 6 and 6' (FIG. 2) extend substantially in parallel with the axis of the cylinder 1 and reciprocate through the cylinder head 5. The rods, at their lower ends, ride on the cams on the camshaft 3 and actuate the rocker arms 23 in order to operate intake and exhaust valves 14 and 14', respectively, on the cylinder head 5 (see FIG. 2).

Figure 2:
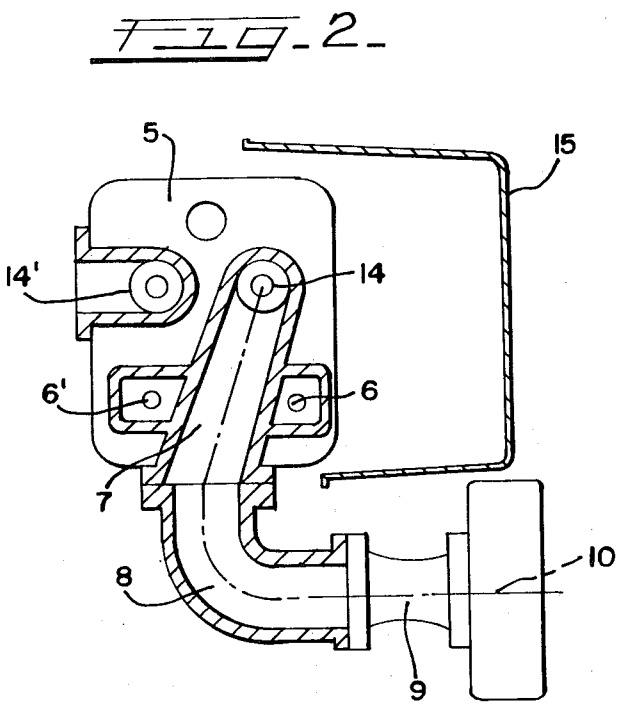
FIG. 2 is a sectional view taken along line 2—2 of FIG. 1.

As best shown in FIG. 2, the cylinder head 5 is formed with an intake port 7 therein, which opens at one end into the combustion chamber of the cylinder bore through the intake valve 14. The port 7 extends between the push rods 6 and 6' and it is substantially perpendicular to the axes of the crankshaft 2 and the push rods 6 and 6'.

The intake port 7 opens downwardly at its outer end which is connected with a carburetor 9 through an L-shaped air intake manifold 8. This manifold 8 curves away from the power output end of the shaft 3 so that the carburetor 9 is positioned substantially in parallel with the crankshaft 2. The intake end of the carburetor 9 is connected directly to an adjacent air cleaner 10. Positioned above the cylinder 1 and crankcase 4 is a fuel tank 11, which is connected by a fuel line (not shown) to the carburetor 9.

The engine with the above arrangement has a compact, substantially square contour as illustrated. The carburetor 9 is located below the cylinder head 5, thereby eliminating virtually all unused space.

Figure 4:
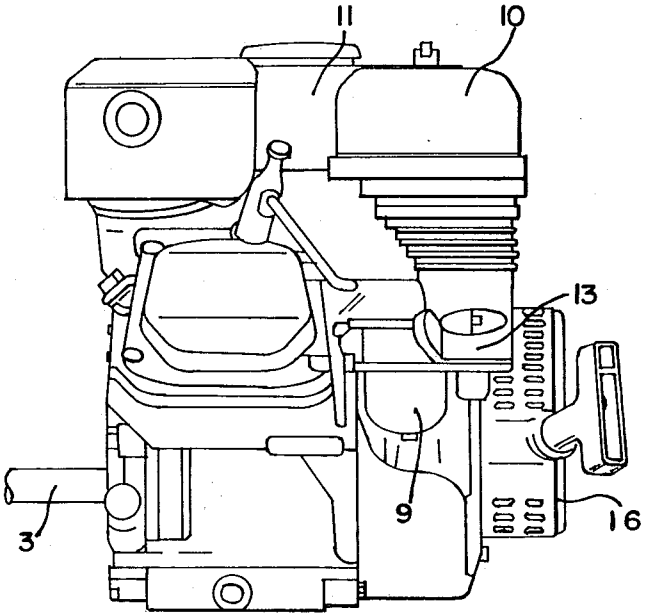
FIG. 4 PRIOR ART
FIG. 4 is a side view of the engine shown in FIG. 3.
Figure 3:
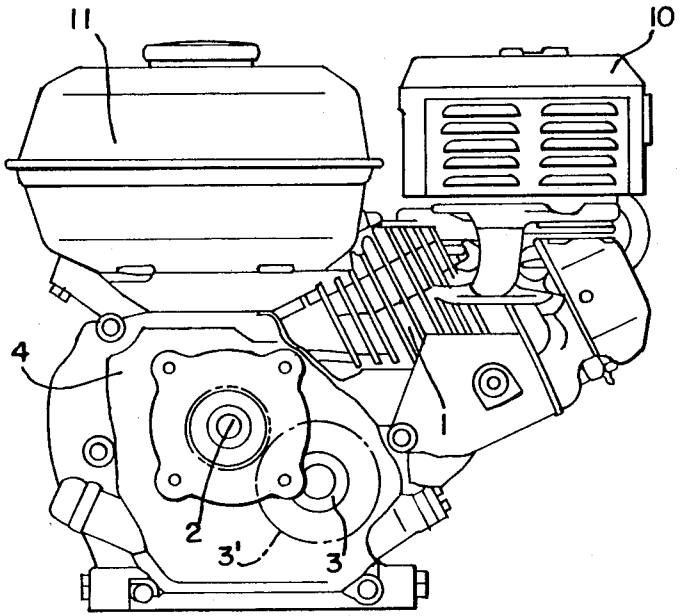
FIG. 3 PRIOR ART
FIG. 3 is a front view of a conventional horizontal-shaft, compact, general-purpose OHV engine.

Moreover, the power output shaft 3 is located at essentially the same height as the crankshaft 2 and at a substantial distance above the bottom of the engine mount 12. This permits a large-diameter power output pulley (not shown) to be mounted on the output shaft, and a sufficient quantity of engine oil to be reserved in the crankcase. The air cleaner 10 is provided closely adjacent to the carburetor 9 and in the direction which is parallel with the shafts 2 and 3, thereby eliminating the need for a connection via an L-shaped inlet pipe 13 (FIG. 4) as heretofore required in prior art engines. In other words, the air cleaner 10 can be connected directly or through a straight, short inlet pipe with the carburetor 9, achieving a simpler construction and improved breathing efficiency. Sufficient vertical separation of the fuel tank 11 from the carburetor 9 permits the gravity feed of fuel even when the engine is tilted considerably.

Although not clearly illustrated, the crankcase 4 and the cylinder 1 are located on one side (adjacent the viewer of FIG. 1) of the engine, and the carburetor 9, the air cleaner 10 and a fan housing 15 are provided on the other side of the engine. As a result, the engine is almost square in side view, and is almost totally cubic.

An engine according to this invention, arranged and constructed as stated above, allows the entire appearance of the engine to be compact and substantially cubic, and allows a large-diameter pulley to be mounted on the output shaft. Accordingly, in lieu of the presently existing side valve engines, overhead valve engines with higher performance can be mounted on cultivators and other equipment without exhibiting any of the above-mentioned troubles with prior art engines. The overhead valve engine involved in the present invention can feed fuel by gravity without any disruption even when the engine is operated at an incline. Therefore, the enginecan be employed without displaying any problems in applications where an engine is inclined while in use, such as in cultivators.

What is claimed is:

1. An overhead valve engine comprising an engine housing having a bottom mounting portion, a horizontal crankshaft and a camshaft rotatably mounted in said housing, said camshaft being in driven engagement with said crankshaft, said camshaft having a pair of cams thereon, said camshaft extending in parallel with and at substantially the same height above said bottom mounting portion as said crankshaft, an output shaft extending from one of said crankshaft and said camshaft, a cylinder formed in said housing and a cylinder head on top of said cylinder, an intake valve and an exhaust valve both provided in said cylinder head and leading to said cylinder, said cylinder extending upwardly from said mounting portion and being inclined at approximately 45 degrees toward and extending over said camshaft, a pair of push rods extending substantially in parallel with said cylinder and extending through said cylinder head, said rods being reciprocatable by engagement with cams on said camshaft to operate said intake and exhaust valves, an air intake port formed in said cylinder head and connected to said intake valve, said port extending between said push rods substantially perpendicularly to said crankshaft, a carburetor connecting with said intake port through a curved inlet manifold such that said carburetor is positioned substantially in parallel with said crankshaft, and an air cleaner connected to said carburetor and adjacent to said carburetor on the side of said carburetor which is opposite said output shaft.

2. An engine as set forth in claim 1, wherein said inlet manifold is L-shaped.

3. An engine as set forth in claim 1, wherein said carburetor and said air cleaner are at a lower level than said cylinder head.

4. An engine as set forth in claim 1, wherein said engine further includes a fuel supply tank mounted on said housing at a higher level than said cylinder head, and a fuel line extending from said fuel tank downwardly to said carburetor.

5. An overhead valve engine comprising a bottom mounting portion, a crankcase mounted on and extending upwardly from said mounting portion, a crankshaft and a camshaft rotatably mounted on said crankcase, said shafts being horizontally displaced and at substantially the same vertical height above said mounting portion, and said shafts having a gear connection therebetween, a cylinder in said crankcase and having a cylinder axis, said axis slanting at an angle of substantially 45° upwardly and over said cam shaft, air intake and exhaust valves at the upper end of said cylinder, a carburetor mounted on a side of said crankcase at a level which is below said valves, and an air inlet manifold extending from said air intake valve downwardly to said carburetor.

6. An overhead valve engine as set forth in claim 5, and further including two push rods extending between said camshaft and said valves, said air inlet manifold extending between said two push rods.

7. An overhead valve engine as set forth in claim 6, wherein said push rods are substantially parallel with said cylinder axis.

* * * * *